United States Patent [19]

Politzer et al.

[11] Patent Number: 4,572,076

[45] Date of Patent: Feb. 25, 1986

[54] CASELESS AMMUNITION FOR AUTOMATIC WEAPONS

[75] Inventors: Anton Politzer, Lauf/Pegnitz; Werner Heberlein, Nuremberg; Helmut Könicke, Rothenbach, Pegnitz, all of Fed. Rep. of Germany

[73] Assignee: Diehl GmbH & Co., Fed. Rep. of Germany

[21] Appl. No.: 589,172

[22] Filed: Mar. 13, 1984

[30] Foreign Application Priority Data

Mar. 16, 1983 [DE] Fed. Rep. of Germany ..... 3309288

[51] Int. Cl.[4] ..... F42B 5/18

[52] U.S. Cl. ..... 102/431; 102/700

[58] Field of Search ..... 102/430–433, 102/282, 275.12, 700; 42/16

[56] References Cited

U.S. PATENT DOCUMENTS

| | | | |
|---|---|---|---|
| 3,577,921 | 5/1971 | Van Langenhoven | 102/431 |
| 3,994,235 | 11/1976 | Politzer et al. | 102/431 |
| 4,123,963 | 11/1978 | Junker | 42/16 |
| 4,195,550 | 4/1980 | Witt et al. | 102/431 |

FOREIGN PATENT DOCUMENTS

| | | | |
|---|---|---|---|
| 1951006 | 4/1970 | Fed. Rep. of Germany . | |
| 1703409 | 5/1972 | Fed. Rep. of Germany . | |
| 2253834 | 5/1974 | Fed. Rep. of Germany | 102/700 |
| 1578101 | 12/1975 | Fed. Rep. of Germany . | |
| 2460391 | 10/1979 | Fed. Rep. of Germany . | |

*Primary Examiner*—Harold J. Tudor

*Attorney, Agent, or Firm*—Scully, Scott, Murphy & Presser

[57] ABSTRACT

Caseless ammunition for cannons, in particular automatic weapons with a selective single or bipartitioned cartridge chamber into which a projectile and a propellent charge are separately introduceable. The ammunition consists of a projectile member with a directly attached, fixedly interconnected propellent charge, and which is completed through a base detonator fuse which is separate from the projectile. The separation between the base detonator fuse and the projectile is undertaken in such a manner that, for the longest employed shell there are always formed two approximately equally lengthy parts.

4 Claims, 3 Drawing Figures

CASELESS AMMUNITION FOR AUTOMATIC WEAPONS

BACKGROUND OF THE INVENTION

1. Field of the Invention

The present invention relates to caseless ammunition for cannons, in particular automatic weapons with a selective single or bipartitioned cartridge chamber into which a projectile and a propellent charge are separately introduceable.

2. Discussion of the Prior Art

From German Pat. No. 24 60 391 there has become known an automatic barreled firearm with a bipartitioned ammunition chamber, into which there can be introduced a projectile and a propellent charge. Hereby, the projectile and the propellent charge are two members which are separated from each other, and which are separately introduced into the bipartitioned ammunition chamber.

In German Laid-open patent application No. 17 03 409 there is disclosed a caseless shell, which consists of a projectile member having a recess provided in the rearward portion thereof for the receipt of a solid propellent charge.

Finally, from German Laid-open patent application No. 19 51 006 there has become known a shell for firearms, which is formed from a projectile and from a propellent charge. The propellent charge, which is constituted of a prefabricated cylindrical body, is form-fittingly interconnected with the projectile.

The ammunition which is constructed in conformance with the above-indicated state of the technology, possesses a propellent charge which is either directly and fixedly interconnected with the projectile, or a propellent charge which is separate from the projectile member. In the first instance, the propellent charge which is precisely correlated with the projectile is a fixed component of the cartridge, while in the second instance a mere projectile member is completed through a predetermined propellent charge member within the weapon. In all instances it must be considered that, as a rule, only a predetermined projectile can be fired from a predetermined weapon. For larger-caliber projectiles, this can then lead to relatively large propellent charges, which makes itself particularly noticeable in the expansion or increase in their lengths. As a consequence, excessively lengthy shells will cause problems when maintained in storage, and above all, during the loading sequence in the weapon. In addition thereto, for propellent charges which are not interconnected with the projectiles, this can lead to mixups with different types of projectile which are to fired.

By means of German Pat. No. 15 78 101 there is, in turn, protected a weapon with a separate ammunition chamber whereby, also in this instance, the propellent charge is separated from the projectile member. Whereas, in German Pat. No. 24 60 391, the cartridge chamber is disclosed as being two almost equally long ammunition chambers, German Pat. No. 15 78 101 discloses two cartridge chambers of extremely differing constructional lengths. In both instances, the precisely mutually correlated ammunition members fail to allow for a better solution to the problem. In addition thereto, for larger-caliber projectiles there is also encountered the risk of a mixup of projectiles with respect to the propellent charge members. However, it is just the larger-caliber weapons with known bipartitioned ammunition chambers, for example, double-drum weapons or double-slide weapons, which are adapted at suitable ammunition constructions for the utilization of different types of shells.

SUMMARY OF THE INVENTION

Accordingly, it is an object of the present invention to provide caseless ammunition of the above-mentioned type which avoids the aforementioned disadvantages and which can be technologically constructed and employed in an extremely simple manner.

Inventively, the foregoing object is achieved in that the ammunition consists of a projectile member with a directly attached, fixedly interconnected propellent charge, and which is completed through a base detonator charge which is separate from the projectile. The separation between the base detonator charge and the projectile is undertaken in such a manner that, for the longest employed cartridge there are always formed two approximately equally lengthy parts. The base detonator fuse is hereby of a particular advantageous configuration for all types of projectiles of the same length or size and the same charge construction. Every projectile evidences a propellent charge component, whose propellent charge is internally ballistically conformed with the base detonator fuse and in correlation with the projectile.

The inventive ammunition allows thereby for all types of projectiles, such as for example, solid projectiles, subcaliber propellent mechanism projectiles and subcaliber fin-stabilized projectile with propellent mechanisms, the same detonator charges or fuses, a simple storage and a simple projectile infeed with extensively uniformly sized ammunition chambers in the weapon. The minimum propellent charge associated with all types of projectiles, pursuant to the invention, can be mass-produced as an always identical base detonator fuse member, and produced and stored separately from the projectile. In case of need, this base detonator fuse member, together with the projectile and propellent charge correlated therewith, is conveyed into the weapon. The ammunition storage in the chamber can always have the same length for the base detonator member as well as for the projectile body. As a result thereof, by means of one weapon there can be fired different projectile types of the same shell.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1:
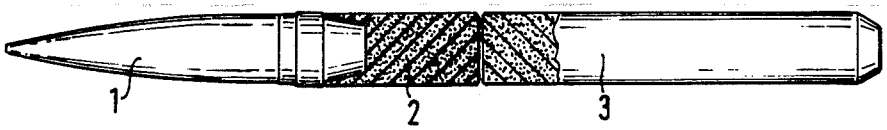
FIG. 1 illustrates a longitudinal view, partly in section, of a caseless ammunition component with a solid projectile.

The ammunition component pursuant to FIG. 1 consists of a solid projectile with an attached propellent charge element 2. The solid projectile 1 and the propellent charge element 2 are precisely inner-ballistically correlated with each other, and form a relatively short structural unit. This ammunition component is completed through a base detonator fuse 3, which possesses the same length and the same propellent construction for all projectile types.

Figure 2:
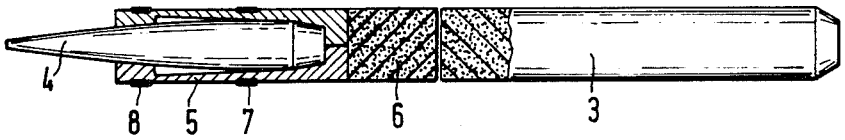
FIG. 2 illustrates a view similar to FIG. 1 of a caseless ammunition component with a subcaliber propellent mechanism projectile.

Illustrated in FIG. 2 is the application of the invention to a subcaliber projectile with a base detonator mechanism. The projectile 4 is arranged so that its rearward portion extends within the propellent cage 5, to the base end of which there is attached the propellent charge component 6. Identified by reference numeral 7 is the guide band, and reference numeral 8 identifies a sliding band. Also this ammunition component is completed through a base detonator fuse 3, which possesses the same length and the same propellent construction as does the base detonator fuse 3 for a solid projectile shown in FIG. 1.

Figure 3:
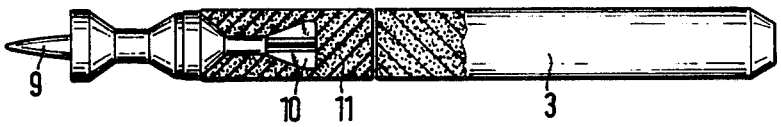
FIG. 3 illustrates a view similar to that of FIG. 1, of a caseless ammunition component with a subcaliber fin-stabilized projectile having a propellent charge mechanism.

A still further type of projectile is illustrated in FIG. 3 of the drawings. Herein, there is shown a subcaliber fin-stabilized projectile, which has its guide mechanism 10 inserted in the therewith correlated propellent charge component 11. The base detonator fuse 3 is also in this instance identical with the component 3 as shown in FIGS. 1 and 2.

The separation for the caseless ammunition pursuant to FIGS. 1 to 3 is always so selected that, for the longest shell, there are always formed two approximately equally long parts, and the once predetermined base detonator fuse 3 always possesses for the different projectile types the same constructional length and the same propellent structure.

I claim:

1. A two part caseless ammunition for automatic weapons having a cartridge chamber in which is separately introduceable a variety of projectiles and matched propellant charges, said ammunition comprising:

a projectile body;

a propellant charge component directly attached to said projectile body and ballistically matched to said projectile body;

a base detonator fuse closely spaced from said projectile body and propellant charge, said base detonator fuse being of the same length for a single caliber size;

said projectile body and propellant charge forming a first part of said caseless ammunition, said base detonator fuse forming a second part of said caseless ammunition, said first and second parts being positioned adjacent and coaxial to each other within said cartridge chamber the length of said projectile body with said propellant charge attached thereto is correlated to be substantially equal to the length of said base detonator fuse for the largest overall length of said caseless ammunition and said projectile body with said propellant charge and said basse detonator fuse being of the same caliber.

2. The caseless ammunition as claimed in claim 1 wherein the base detonator fuse has the same structure for any type of projectile.

3. The caseless ammunition as claimed in claims 1 or 2 wherein said propellant charge component is internally ballistically conformed to cooperate with said base denonator fuse is correlation with the inner-ballistic requirements of the type of projectile utilized.

4. The caseless ammunition of claim 1 wherein said cartridge chamber is a single chamber.

* * * * *